US005161596A

United States Patent [19]

Fischer et al.

[11] Patent Number: 5,161,596

[45] Date of Patent: Nov. 10, 1992

[54] METHOD FOR COMPRESSING GRANULAR MOLDING MATERIALS

[75] Inventors: Kurt Fischer; Hans Leutwiler, both of Schaffhausen, Switzerland

[73] Assignee: Georg Fischer AG, Schaffhausen, Switzerland

[21] Appl. No.: 687,828

[22] Filed: Apr. 19, 1991

[30] Foreign Application Priority Data

Apr. 20, 1990 [CH] Switzerland ..... 01353

[51] Int. Cl.[5] ..... B22C 15/28

[52] U.S. Cl. ..... 164/38; 164/195

[58] Field of Search ..... 164/38, 37, 20, 195, 164/200

[56] References Cited

U.S. PATENT DOCUMENTS

| | | | |
|---|---|---|---|
| 4,306,609 | 12/1981 | Fischer et al. | 164/37 |
| 4,415,015 | 11/1983 | Zadera | 164/37 |
| 4,505,316 | 3/1985 | Tanner | 164/20 X |
| 4,750,540 | 6/1988 | Boenisch | 164/38 |
| 4,828,007 | 5/1989 | Fischer et al. | 164/37 |
| 4,828,013 | 5/1989 | Fischer | 164/200 X |
| 4,860,817 | 8/1989 | Joern et al. | 164/37 X |
| 4,921,035 | 5/1990 | Leutwiler | 164/37 |
| 5,020,582 | 6/1991 | Damm et al. | 164/37 |
| 5,024,161 | 6/1991 | Fischer et al. | 164/37 X |

*Primary Examiner*—J. Reed Batten, Jr.
*Attorney, Agent, or Firm*—Bachman & LaPointe

[57] ABSTRACT

Foundry moldings are manufactured in an economic manner without increasing cycle time comprises a 3-stage method including the steps of feeding the molding material by means of compressed air into a molding container and thereafter precompressing the molding material by applying a pressure surge to the surface thereof and thereafter recompressing said precompressed molding material to final compression. The resulting foundry moldings are homogeneous in structure and structural integrity.

9 Claims, 1 Drawing Sheet

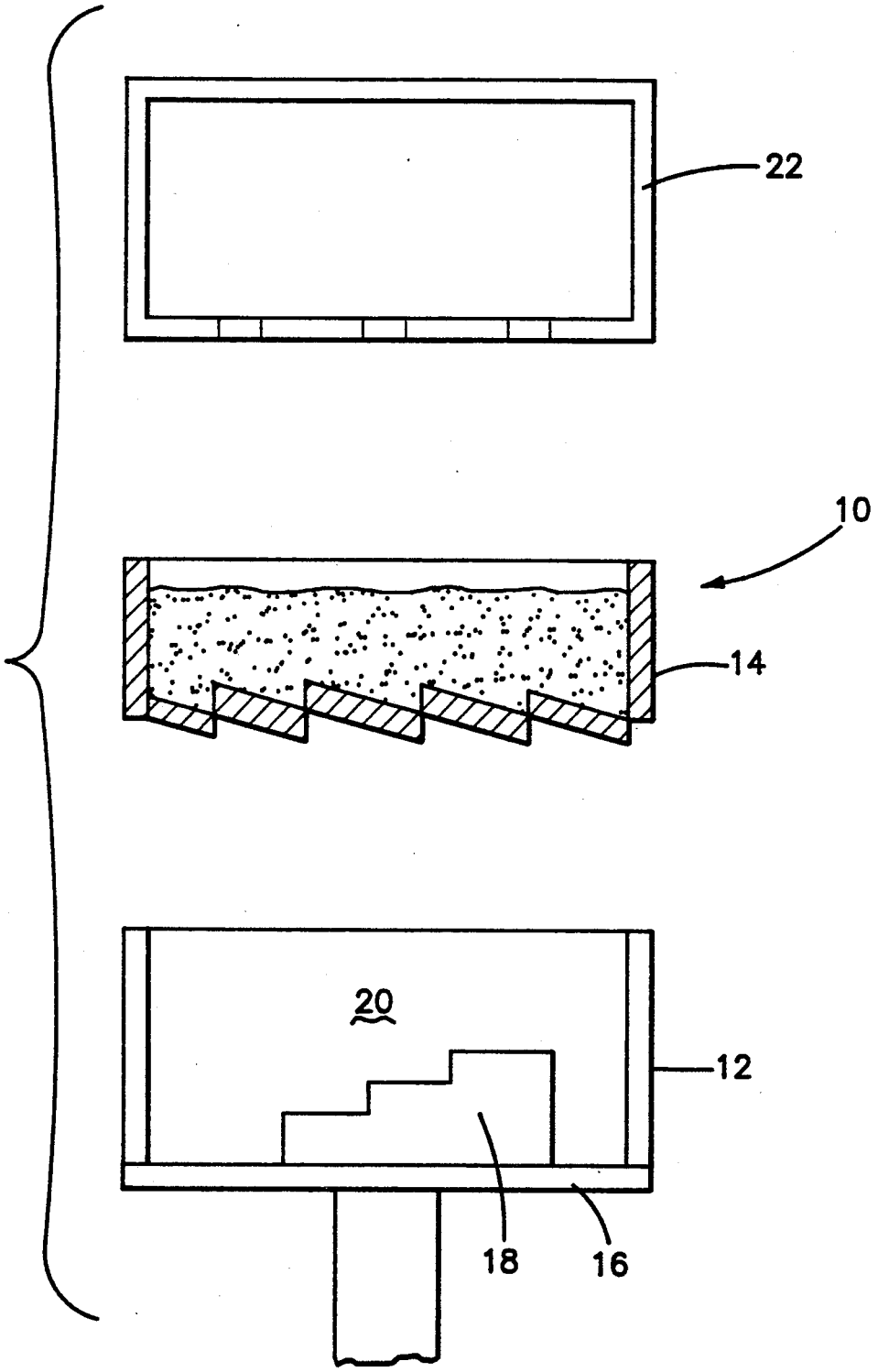
22
10
14
20
12
18
16

METHOD FOR COMPRESSING GRANULAR MOLDING MATERIALS

BACKGROUND OF THE INVENTION

The present invention relates to a method and a device for compressing granular molding materials, in particular foundry molding materials, wherein the molding material is introduced into a molding device comprising a pattern plate having pattern arranged thereon, and a filling and molding frame.

The compression of granular molding materials for the purposes of manufacturing foundry and sand moldings is known from various methods such as those described in U.S. Pat. Nos. 4,415,015 and 4,828,007 which are assigned to the assignee of the instant invention.

It is known to distribute molding material either (1) loose over a pattern arranged in the molding box on the pattern plate and then subsequently compressing it (mechanically or by means of a compressed air surge) or (2) shooting the molding material from a supply container directly into the molding box.

It has been shown however, that neither of these methods guarantee optimum results. Difficulties arise particularly with regard to the homogeneity of the compressed molding material.

With gas pressure methods in which the compression process occurs by means of a gas pressure, wherein either a gas mixture is led by ignition to an exothermic reaction, or a highly compressed pressure gas which is released for a short time, the molding device is filled with molding sand from a sand container with a predetermined quantity of molding sand. The sand container is driven over the molding device and swung away after emptying the container of sand. Subsequently a compressing unit is positioned over the molding device and the pressure surge triggered.

These method stages, the swinging to and fro of the sand container on the one hand and the pressure unit on the other hand are detrimental to cycle time. The demand for economical manufacturing requires shorter cycle times.

Accordingly, it is the principal object of the present invention to improve the know methods so that evenly compressed moldings with reproducibility and great hardness can be manufactured in the shortest cycle times possible in an economic manner.

SUMMARY OF THE INVENTION

In accordance with the present invention the foregoing object is readily obtained.

The method of the present invention employs a molding device having a pattern plate with a pattern arranged thereon and a molding frame arranged on the pattern plate and defining therewith a molding space to receive molding material to be compressed. In accordance with the method of the present invention, a first stage feeding of a predetermined amount of molding material is fed to the molding space of the molding device by a carrier medium. Thereafter, in a second stage, a pressure surge is applied over the granular material in the molding space for a predetermined period of time so as to precompress the granular material. Thereafter, in a third stage, recompression of the granular material is carried out so as to obtain final compression of the granular material. The device of the present invention comprises an arrangement for carrying out the 3-stage compression method of the present invention as aforesaid which allows for shortened cycle times for compressing the granular molding material.

DETAILED DESCRIPTION OF THE DRAWINGS

The figure is a schematic of a molding device in accordance with the principles of the present invention.

DETAILED DESCRIPTION

In accordance with the present invention, a molding device 10 is provided which consists of a molding frame 12 and a filling frame 14 wherein the molding frame includes a pattern plate 16 having a pattern 18 arranged thereon to define a molding space 20 with the molding frame. A sand supply container (filling frame 14) with a dosed quantity of sand sufficient for filling the molding space of the molding device is arranged over the molding frame. Over the sand supply container there is arranged a pressure unit 22, such as a pulse generator. The pulse generator consists substantially of a compressed air container and is separated by means of a valve (not shown) from the sand supply container.

The introduction of the molding material or the sand into the molding space or molding frame occurs according to the invention by the use, known per se, of a compressed air current as carrier medium. For this purpose the previously dosed quantity of molding material required for shaping is prepared in a special supply container, which is brought preferably over the molding box and coupled therewith. This supply container possesses connections for the compressed air supply as well as opening elements sealable by means of a blocking device downwards towards the molding box (not shown). After opening the blocking device the molding material is brought by means of the compressed air current over the pattern in the molding space. The use of compressed air as carrier medium provides for a homogeneous distribution of the particle-shaped molding material in the molding space.

In the base of the molding device openings, preferably air filters such as slotted nozzles are provided, so that the compressed air current can flow through the molding material, which results in a particularly homogeneous distribution of the molding material over the pattern in the molding space. In comparison to the present invention, a loose distribution of the molding material or the shooting-in of the molding material with compressed air results in an uncontrollable, inhomogeneous distribution of the particle-shaped molding material. In such a process the undesirable bridge formation cannot be avoided.

After introduction of the molding material, i.e., once all the material from the supply container is filled into the molding box by means of a carrier medium, the supply of the compressed air current can still be maintained. In this way a pressure of up to 20 bar is built up by means of a pressure increase gradient (dp/dt) of 10 to 1000 bar/sec, preferrably 10 to 200 bar/sec, whereby an effective and optimum precompression of the molding material is achieved. This precompression stage lasts preferably until the pressure in the molding container is equal to the maximum pressure in the supply line of the compressed air current. The supply of the compressed air is now, for example, interrupted by closing the blocking device at the supply container. A lengthened supply of the compressed air could also occur, however, by way of a separate supply line.

The molding material precompressed in the manner described above must again be compressed subsequently to final compression which can occur mechanically, by the use of a pressure plate, or preferably also by a pressure surge, which can generate pressure in an abrupt manner.

The 3-stage compression sequence of the present invention has the advantage that the same device can be used for the supply of molding material and compression medium as well as for regulating compressed air for the compressed air current in the first two stages as well as for the subsequent compression, and thus a device change or additional elements, such as pressing elements provided with valves or openings are spared which results in short cycle times in the manufacturing sequence.

The advantage of the described method lies substantially in that no precious cycle time is lost by the swinging to and fro of the sand container or the pressure unit, wherein at the same time spill sand is substantially reduced.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method for compressing granular molding materials wherein molding material is introduced into a molding device having a pattern plate with a pattern arranged thereon, a molding frame arranged on the pattern plate and defining therewith a molding space and a filling frame for feeding molding material to the molding space, the improvement comprising:

a first stage feeding of a predetermined amount of molding material to the molding space by means of a carrier medium wherein the carrier medium is a gaseous medium;

thereafter applying in a second stage a pressure surge over said granular material in said molding space for a predetermined time so as to obtain precompression of said granular material; and thereafter in a third stage recompressing said granular material so as to obtain final compression of said granular material.

2. A method according to claim 1 wherein the gaseous medium is compressed air.

3. A method according to claim 1 wherein said carrier medium passes through said molding material and air filters attached in the pattern plate.

4. A method according to claim 1 wherein the pressure surge in the second stage is limited to a maximum pressure of 20 bar.

5. A method according to claim 4 wherein the pressure gradient (dp/dt) of the pressure surge is increasing continuously.

6. A method according to claim 5 wherein the pressure increase gradient is modified in a controlled manner.

7. A method according to claim 5 wherein the pressure gradient in the second stage lies between 10 to 1000 bar/sec.

8. A method according to claim 6 wherein the pressure gradient lies between 10 and 200 bar/sec.

9. A method according to claim 1 wherein the recompression in the third stage occurs mechanically by means of a pressure plate.

* * * * *